US008303381B2

(12) United States Patent
Schwartz

(10) Patent No.: US 8,303,381 B2
(45) Date of Patent: Nov. 6, 2012

(54) KNIFE SHARPENER WITH ANTI-ROCKING BLADE-CONFORMING CLAMPING MEMBERS

(75) Inventor: Edward A. Schwartz, Amherst, NY (US)

(73) Assignee: Arthur Lansky Levine & Associates, Henderson, NV (US)

( * ) Notice: Subject to any disclaimer, the term of this patent is extended or adjusted under 35 U.S.C. 154(b) by 371 days.

(21) Appl. No.: 12/688,068

(22) Filed: Jan. 15, 2010

(65) Prior Publication Data

US 2011/0177764 A1 Jul. 21, 2011

(51) Int. Cl.
*B24B 41/06* (2012.01)
*B24B 3/54* (2006.01)

(52) U.S. Cl. ..... 451/371; 451/321

(58) Field of Classification Search ..... 451/371, 451/321, 175, 320; 269/3
See application file for complete search history.

(56) References Cited

U.S. PATENT DOCUMENTS

| | | | | |
|---|---|---|---|---|
| 3,432,159 | A | 3/1969 | Rakatansky | |
| 3,924,360 | A * | 12/1975 | Haile et al. | 451/371 |
| 4,320,892 | A | 3/1982 | Longbrake | |
| 4,441,279 | A | 4/1984 | Storm et al. | |
| 4,471,951 | A | 9/1984 | LeVine | |
| 4,512,112 | A | 4/1985 | LeVine | |
| 4,580,769 | A | 4/1986 | Pappas | |
| 4,714,239 | A | 12/1987 | LeVine | |
| 4,777,770 | A | 10/1988 | LeVine | |
| 5,138,801 | A | 8/1992 | Anthon et al. | |
| 6,227,958 | B1 * | 5/2001 | Neuberg | 451/367 |
| 6,579,163 | B1 | 6/2003 | Ross et al. | |
| 7,017,892 | B2 | 3/2006 | Hurrlein et al. | |
| 7,052,385 | B1 | 5/2006 | Swartz | |
| 7,144,310 | B2 | 12/2006 | Longbrake | |
| 7,172,183 | B1 | 2/2007 | Yang | |

* cited by examiner

*Primary Examiner* — Dung Van Nguyen
(74) *Attorney, Agent, or Firm* — Simpson & Simpson, PLLC

(57) ABSTRACT

A clamping-type knife sharpener is designed with anti-rocking blade holding capability. The knife sharpener includes first and second clamping members and a clamping member adjustment mechanism configured to adjustably manipulate the clamping members into clamping engagement with a knife blade to be sharpened. The knife blade is maintained by the clamping members in orientation with a planar knife sharpener axis extending along a centerline of the knife blade that passes through an edge of the knife blade. First and second deformable clamping boots are respectively disposed on the first and second clamping members. The first and second clamping boots have respective first and second clamping faces adapted to engage the knife blade when the clamping members are in the clamping engagement with the knife blade. At least one of the clamping faces has a blade-conforming contour that substantially conforms to a surface contour of the knife blade and restrains the knife blade against rocking during sharpening. The blade-conforming contour may include at least one region that is angled with respect to the planar knife sharpener axis.

20 Claims, 10 Drawing Sheets

KNIFE SHARPENER WITH ANTI-ROCKING BLADE-CONFORMING CLAMPING MEMBERS

BACKGROUND

1. Field of the Invention

The present invention relates to knife sharpeners. More particularly, the invention concerns knife sharpeners with clamping members that immobilize a knife blade during sharpening.

2. Description of the Prior Art

By way of background, knife sharpeners are known that include a pair of clamping members for clamping a knife to immobilize it during sharpening. Such knife sharpeners are sometimes designed to be hand-held, and in other cases are designed for mounting to a fixed object such as a table or counter. The sharpeners may additionally include guides for guiding the angle of a sharpening stone relative to the knife blade. In other designs, the guides are not present and the sharpening stone angle is controlled by the user. It is to improvements in the field clamping-type knife sharpeners that the present invention is directed.

SUMMARY

A clamping-type knife sharpener is designed with anti-rocking blade holding capability. The knife sharpener includes first and second clamping members and a clamping member adjustment mechanism configured to adjustably manipulate the clamping members into clamping engagement with a knife blade to be sharpened. The knife blade is maintained by the clamping members in orientation with a planar knife sharpener axis that passes through the edge of the knife blade. First and second deformable clamping boots are respectively disposed on the first and second clamping members. The first and second clamping boots have respective first and second clamping faces adapted to engage the knife blade when the clamping members are in clamping engagement with the knife blade. At least one of the clamping faces has a blade-conforming contour that substantially conforms to a surface contour of the knife blade and restrains the knife blade against rocking during sharpening. The blade-conforming contour may include at least one region that is angled with respect to the planar knife sharpener axis.

BRIEF DESCRIPTION OF THE DRAWINGS

The foregoing and other features and advantages of the invention will be apparent from the following more particular description of example embodiments, as illustrated in the accompanying Drawings, in which.

DETAILED DESCRIPTION OF EXAMPLE EMBODIMENT

Figure 1:
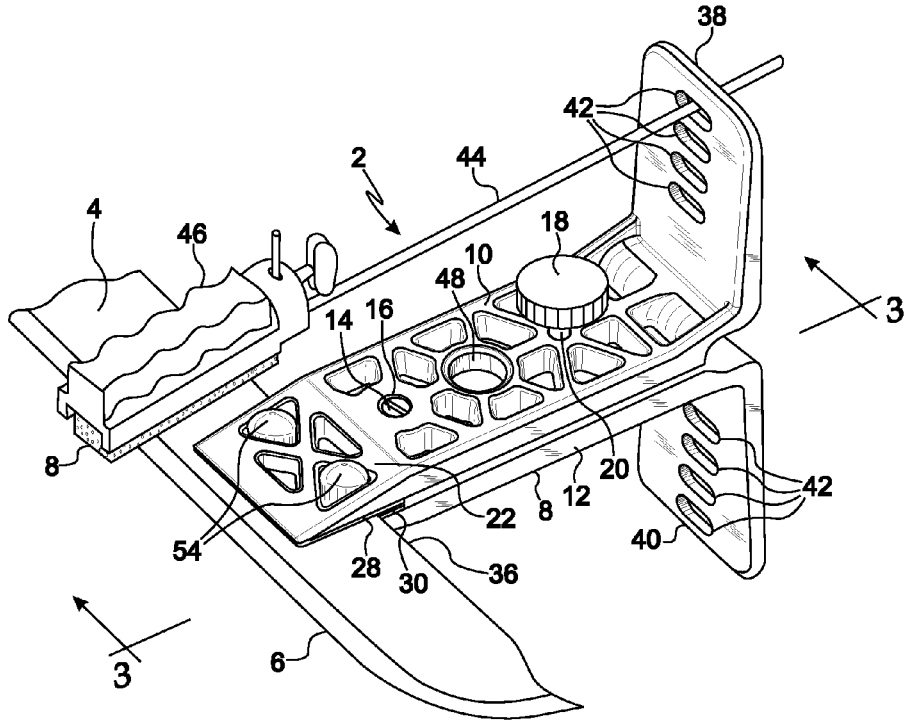
FIG. 1 is a perspective view showing an example knife sharpener that may be constructed in accordance with the present disclosure.
Figure 2:
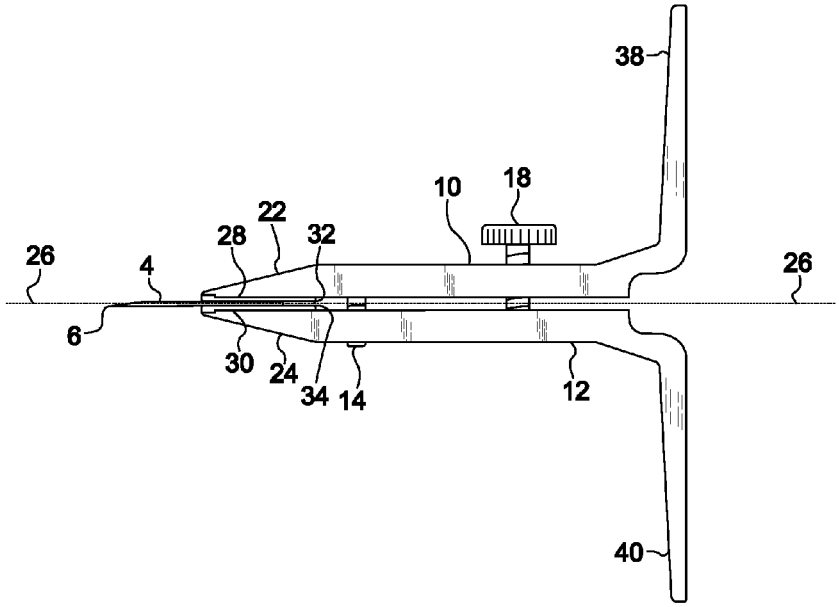
FIG. 2 is a side view of the knife sharpener of FIG. 1.
Figure 3:
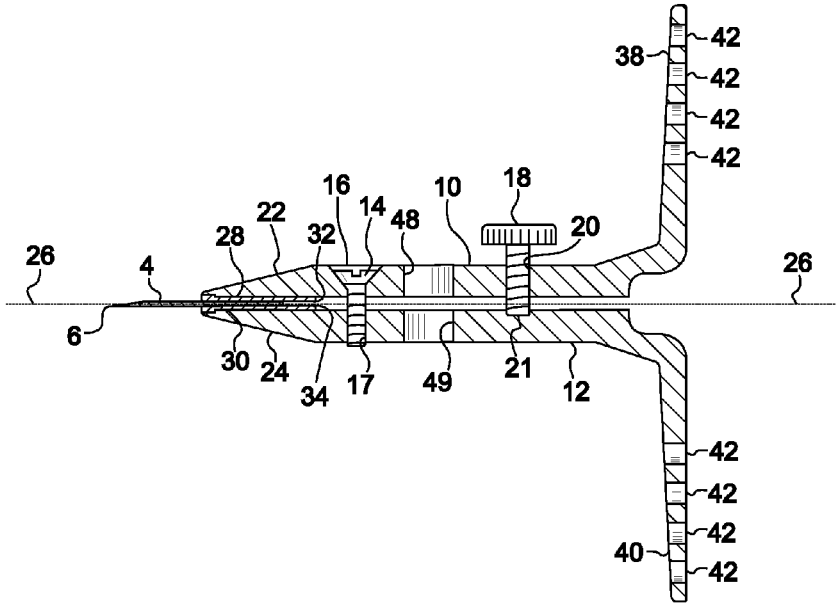
FIG. 3 is a cross-sectional side view of the knife sharpener of FIG. 1 taken along line 3-3 in FIG. 1.

Turning now to the drawing figures, wherein like reference numerals are used to represent like elements in all of the several views, FIGS. 1-3 illustrates one possible embodiment of a knife sharpener 2 that may be constructed in accordance with the present disclosure. In the illustrated embodiment, the sharpener 2 is constructed substantially in accordance with the disclosure of commonly assigned U.S. Pat. No. 4,512,112, the entire contents of which are incorporated by reference herein. It should be understood, however, that the depiction of the sharpener of U.S. Pat. No. 4,512,112 is for purposes of illustration only. As will be appreciated from the ensuing discussion, virtually any clamping-type knife sharpener that is adapted to clamp a knife during sharpening may be modified to implement the anti-rocking blade-clamping functionality described herein.

The sharpener 2 is shown in FIGS. 1-3 in a clamping position clamping a knife blade 4 so that its edge 6 can be sharpened by a sharpening stone 8. The sharpening stone 8 is positionable at an appropriate knife sharpening angle and is operable in the usual manner to effect repeated blade sharpening strokes across the edge 6. Clamping of the knife blade 4 is effected by first and second clamping members 10 and 12. A clamping member adjustment mechanism is used to manipulate the clamping members into their clamping engagement position. The adjustment mechanism may be constructed in various ways. In the illustrated embodiment, it includes a main screw 14 that extends through an aperture 16 in the clamping member 10 and is threadably received in a tapped bore 17 (see FIG. 3) of the clamping member 12. A secondary thumb screw 18 may also be provided. This screw is threadably received in a tapped bore 20 of the clamping member 10. The end of the thumb screw 18 bears against a surface of the clamping member 12, where it is received in dimple or complementary depression 21 (see FIG. 3) to prevent sidewise movement of the clamping member 10 and 12 relative to each other. The clamping members 10 and 12 have front end portions that define a pair of jaws 22 and 24 to hold the knife blade 4 in position during sharpening. More particularly, the knife blade 4 is maintained by the clamping member jaws 22 and 24 in orientation with a planar knife sharpener axis 26 (see FIGS. 2 and 3). This axis extends through the knife edge 6 and along a centerline of the knife blade that bisects the blade in symmetrical fashion.

In accordance with the present disclosure, the functionality of the sharpener 2 is enhanced by providing first and second deformable clamping boots 28 and 30 that are designed to grip the knife blade 4 and prevent it from rocking during sharpening. The clamping boots 28 and 30 are respectively disposed on the jaws 22 and 24 of the clamping members 10 and 12. They can be made from any suitable material that is relatively soft or resilient, including PVC (polyvinyl chloride), TPE (thermoplastic elastomer), silicone rubber or the like. By way of example, and not by way of limitation, the clamping boots 28 and 30 may have a Shore A durometer hardness in a range of approximately 40-75, with softer or harder materials also being possible. Any suitable fabrication technique, such as injection molding, may be used to form the clamping boots 28 and 30. As described in more detail below, the clamping boots 28 and 30 have respective first and second clamping faces 32 and 34 that engage the knife blade 4 when the clamping member jaws 22 and 24 are in clamping engagement with the blade. One or both of the clamping faces 32 and 34 may have a blade-conforming contour that substantially conforms to a surface contour of the knife blade 4. The blade-conforming contour may comprise at least one region that is angled with respect to the planar knife sharpener axis 26 in order to restrain the knife blade against rocking during sharpening. One or both of the clamping faces 32 and 34 may also have surface grip patterns that are selected to assist in holding the knife blade 4 without sliding relative to the jaws 22 and 24.

In order to secure the knife blade 4 between the clamping boots 28 and 30, the main screw 14 is backed off to separate the clamping member jaws 22 and 24 until the space between the clamping faces 32 and 34 is wide enough to receive the thickest portion of the knife blade, which is typically the spine 36 at the back of the blade. The thumb screw 18 may then be manipulated to force clamping members 10 and 12 away from each other in the area of the thumb screw to stabilize the clamping members and so that the jaws 22 and 24 will tightly clamp the knife blade 4 between the clamping faces 32 and 34.

In the sharpener embodiment shown in FIGS. 1-3, the clamping members 10 and 12 are optionally formed with a pair of guide members 38 and 40 that extend outwardly from respective rear end portions of the clamping members. Each guide member 38 and 40 includes a plurality of elongated apertures 42 that receive a guide rod 44 extending from a holder 46 that carries the sharpening stone 8. By inserting the guide rod 44 in different apertures 42, the angle of the sharpening stone 8 relative to the knife edge 6 can be changed. Once the proper angle has been selected, the guide rod 44 will maintain the sharpening stone 8 at a substantially constant angular orientation relative to the knife edge 6 during sharpening. A sharpening procedure that may be used to sharpen the knife edge 6 is described in commonly owned U.S. Pat. No. 4,471,951, the entire contents of which are incorporated by reference herein. This involves making repeated blade sharpening strokes in which the sharpening stone 8 is pushed diagonally across the knife edge 6 (i.e., toward the guide members 38 and 40 and lengthwise along the blade 4) during each stroke. A bore 48 may be provided in each of the clamping members 10 and 12 in order to receive a pin or post (not shown) that allows the sharpener 2 to be carried by a handle member or attached to a support structure (such as a table or counter) during sharpening. After one side of the knife edge 6 has been sharpened, the sharpener 2 is inverted in order to perform the same procedure to sharpen the other side of the knife edge.

Figure 4:
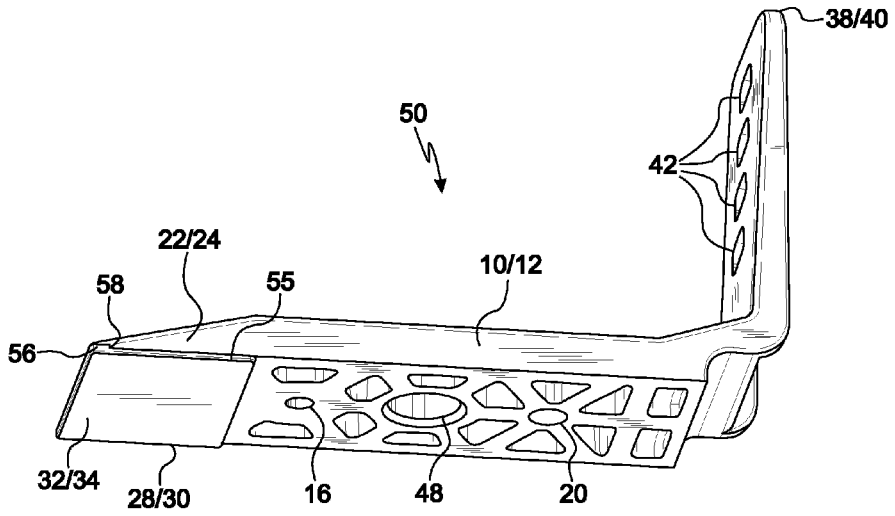
FIG. 4 is a perspective view showing a clamping side of a first clamping member embodiment of the knife sharpener of FIG. 1.

The clamping members 10 and 12 and their respective clamping boots 28 and 30 may be constructed in various ways. FIGS. 4-7 illustrate a first example clamping member embodiment 50. In this embodiment, the jaws 22/24 of the clamping members 10/12 are constructed with one or more clamping member openings 52 (see FIG. 6). The one or more clamping member openings 52 are designed to receive one or more projections 54 (see FIG. 7) formed on a base 55 of the clamping boots 28/30, thereby allowing the clamping boots to be mounted to the clamping members 10/12. As shown in FIGS. 4 and 6, additional openings of various size and shape may also be formed in other parts of the clamping members 10/12. These help reduce clamping member material requirements and weight.

Figure 7:
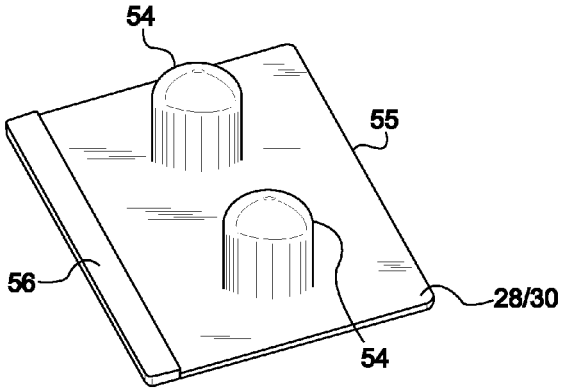
FIG. 7 is a perspective view showing an example clamping boot of the clamping member embodiment of FIG. 4.
Figure 7A:
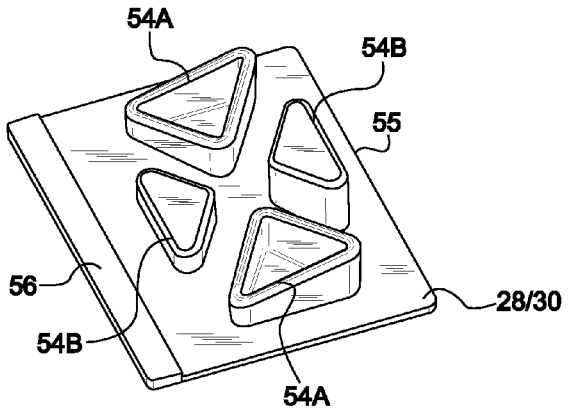
FIG. 7A is a perspective view showing another example clamping boot of the clamping member embodiment of FIG. 4.

As shown in FIG. 7, the one or more clamping boot projections 54 may include a pair of substantially cylindrical posts having rounded ends that assist in guiding the posts into the openings 52. The projections 54 may also be slightly tapered to further assist this effort and to provide a suitable draft angle if the clamping boots 28/30 are formed by injection molding. The number of clamping boot projections 54, as well as their shape and configuration may also be varied. For example, as alternatively shown in FIG. 7A, the one or more clamping boot projections 54 may include one or more projections 54A that are hollow and one or more projections 54B that are solid. As also illustrated in FIG. 7A, the projections 54A and 54B may be shaped and configured to conform to the geometry of the one or more clamping member openings 52. Other projection designs, such as projections having ribs, flanges or other projections that engage the sides of the one or more clamping member openings 52, could also be used. In FIG. 7A, the solid projections 54B may be sized to be slightly tight in the openings 52 in order to prevent movement of the clamping boots 28/30 during use. The hollow projections 54A may be designed to fit into the openings 52 a bit easier in order to facilitate clamping boot mounting. It will also be seen that the projections 54A and 54B increase in height when moving away from the tip of the jaws 22/24 in order to take advantage of the increasing jaw thickness.

Figure 5:
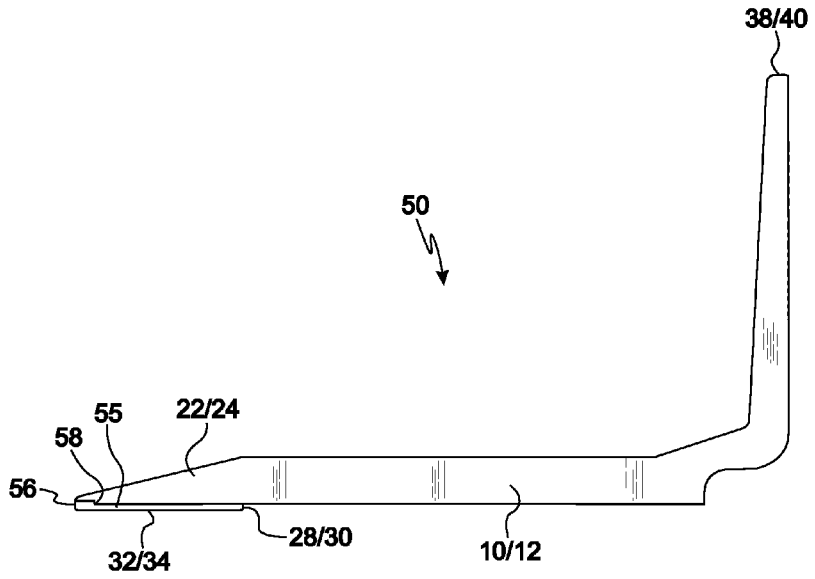
FIG. 5 is a side view of the clamping member embodiment of FIG. 4.
Figure 6:
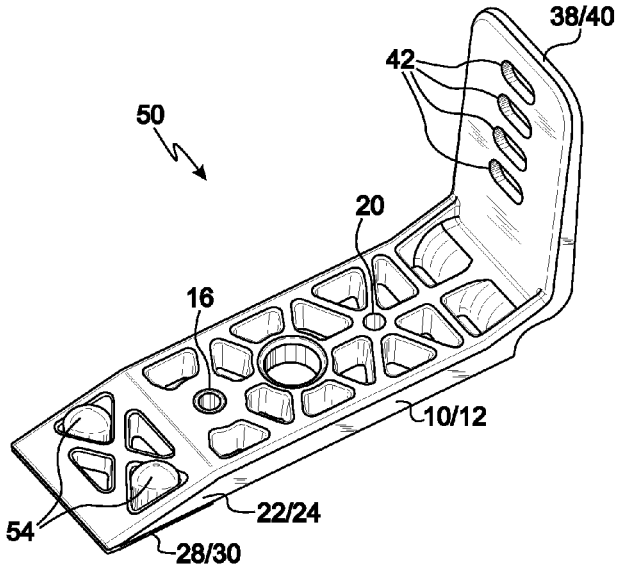
FIG. 6 is a perspective view showing a non-clamping side of the clamping member embodiment of FIG. 4.

FIGS. 4, 5, 7 and 7A illustrate a further feature of the clamping boots 28/30 in which a small flange 56 is formed on the base 55 in correspondence with a small notch recess 58 formed at the tip of each clamping member jaw 22/24 (see FIGS. 4 and 5). When the clamping boots 28/30 are removed from the jaws 22/24, the recess 58 provides a secondary clamping surface of the clamping members 10/12 that can be used to clamp the back edge 26 of the knife blade 4 for blades that are small and thin. The remaining surface area of each of the clamping member jaw 22/24 defines a primary clamping surface that can clamp additional surface area of the knife blade 4. When the clamping boots 28/30 are mounted on the clamping member jaws 22/24, the boots cover the primary clamping surface of each clamping member 10/12 and the flange 56 is received in the recess 58 such that the secondary clamping surface is covered and a single clamping surface is provided by each of the clamping faces 32/34.

Figure 8:
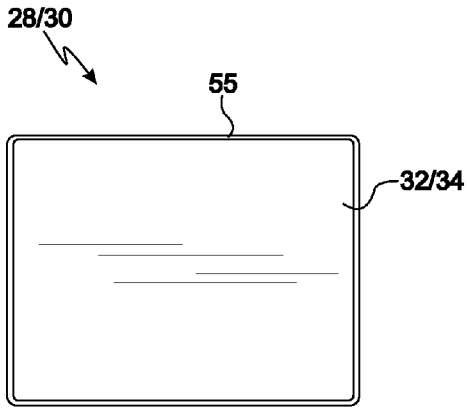
FIG. 8 is a plan view showing an example clamping face grip pattern of the clamping boot of FIG. 7.
Figure 9:
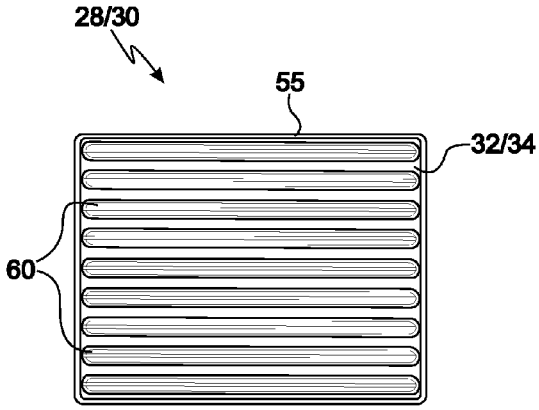
FIG. 9 is a plan view showing another example clamping face grip pattern of the clamping boot of FIG. 7.
Figure 10:
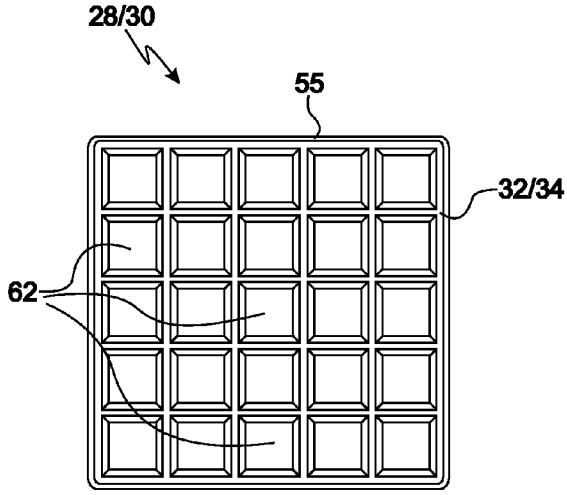
FIG. 10 is a side view showing an example clamping face contour of the clamping boot of FIG. 7.
Figure 11:
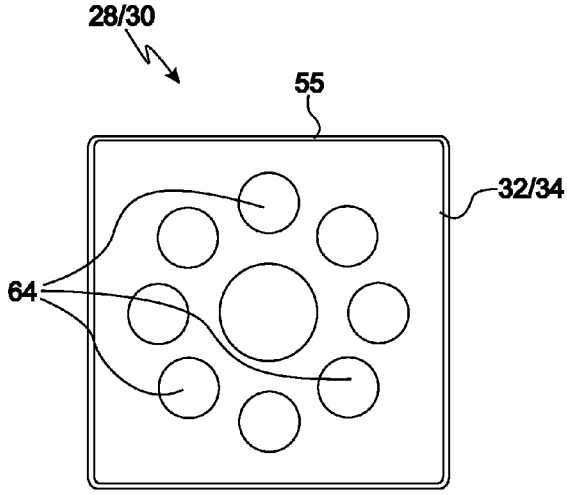
FIG. 11 is a side view showing another example clamping face contour of the clamping boot of FIG. 7.

Turning now to FIGS. 8-12, one or both of the clamping faces 32/34 of the clamping boots 28/30 may have a variety of surface grip patterns and surface contours. With respect to grip patterns, FIG. 8 illustrates that one or both of the clamping faces 32/34 may be substantially smooth. FIGS. 9-11, on the other hand, illustrate that one or both of the clamping faces 32/34 may be patterned, for example, with linear ridges 60 (FIG. 9), prongs or projections 62 (FIG. 10), or dimples or cups (FIG. 11). It will be appreciated that many other grip pattern shapes could also be used.

Figure 12:
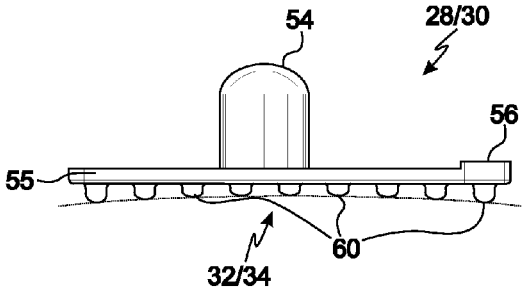
FIG. 12 is a side view showing another example clamping face contour of the clamping boot of FIG. 7.
Figure 13:
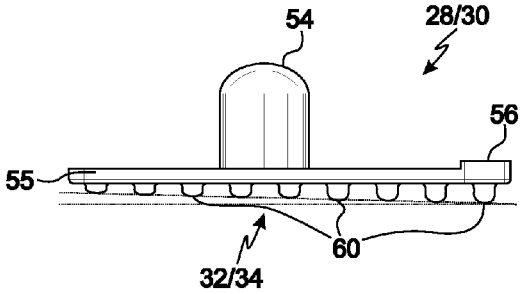
FIG. 13 is a perspective view showing a non-clamping side of a second clamping member embodiment of the knife sharpener of FIG. 1.
Figure 14:
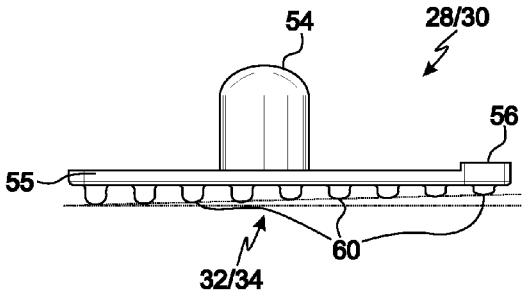
FIG. 14 is a perspective view showing a side wall configuration of the clamping member embodiment of FIG. 13.

With respect to surface contours, FIGS. 12-14 illustrate contours that are configured to conform to different surface configurations of the knife blade 4. The contours can be formed by varying the height of the surface pattern elements (e.g., ridges 60) formed on one or both of the clamping faces 32/34. Alternatively, the contours could be formed by varying the material thickness of the base 55 underlying one or both of the clamping faces 32/34. In each of FIGS. 12-14 the clamping boots 28/30 are oriented so that the edge 6 of the blade 4, which is not shown in FIGS. 12-14, would lie on the right side of the figures and the spine 36 of the blade would lie on the left side.

FIG. 12 illustrates that one or both of the clamping faces 32/34 may have a blade-conforming contour that comprises a non-linear configuration. For example, the blade-conforming contour may have a radiused or arc-shaped configuration, or a configuration having some other type of curvature. With this configuration on one or both of the clamping faces 32/34, the blade-conforming contours of the clamping faces 32/34 will cooperate (when clamped together) to define a knife receiving clamping cavity in which a spacing between the first and second clamping surfaces first increases moving from the edge 6 of the knife blade 4 (right side of FIG. 12) toward the spine 36 (left side of FIG. 12), and thereafter decreases when continuing to move away from the edge.

FIGS. 13 and 14 illustrate that one or both of the clamping faces 32/34 may have a blade-conforming contour that comprises a linear configuration. For example, the blade-conforming contour may have a linear angled configuration, with FIG. 13 showing a downward sloping angle and FIG. 14 showing an upward sloping angle when moving in a direction from the edge 6 to the spine 36 of the knife blade 4. If the configuration of FIG. 13 is provided on one or both of the clamping faces 32/34, the blade-conforming contours of the clamping faces 32/34 will cooperate (when clamped together) to define a knife receiving clamping cavity in which a spacing between the first and second clamping surfaces increases when moving away from the edge 6 of the knife blade 4 (right side of FIG. 13) toward the spine 36 (left side of FIG. 13). If the configuration of FIG. 14 is provided on one or both of the clamping faces 32/34, the blade-conforming contours of the clamping faces 32/34 will cooperate (when clamped together) to define a knife receiving clamping cavity in which a spacing between the first and second clamping surfaces decreases when moving away from the edge 6 of the knife blade 4 (right side of FIG. 14) toward the spine 36 (left side of FIG. 14). It would also be possible to use a blade-conforming contour comprising a linear non-angled configuration.

Figure 15:
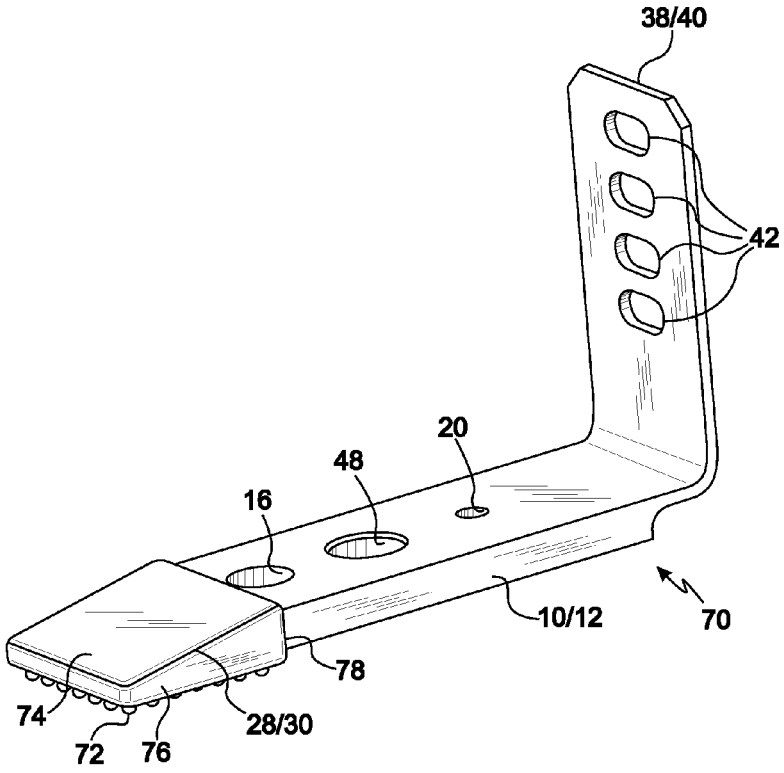
FIG. 15 is a perspective view showing an example clamping face grip pattern of a clamping boot of the clamping member embodiment of FIG. 13.
Figure 16:
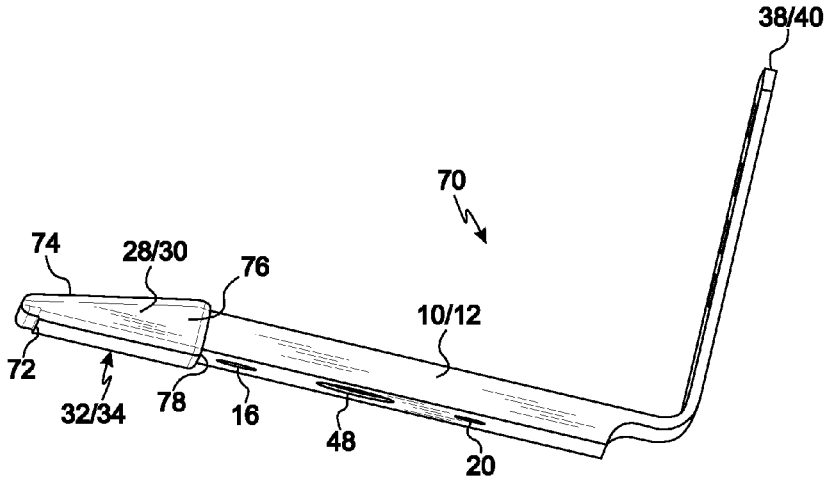
FIG. 16 is a perspective view showing another example clamping face grip pattern of a clamping boot of the clamping member embodiment of FIG. 13; and, FIG. 17 is a bottom plan view showing another example clamping face grip pattern of a clamping boot of the clamping member embodiment of FIG. 13.
Figure 17:
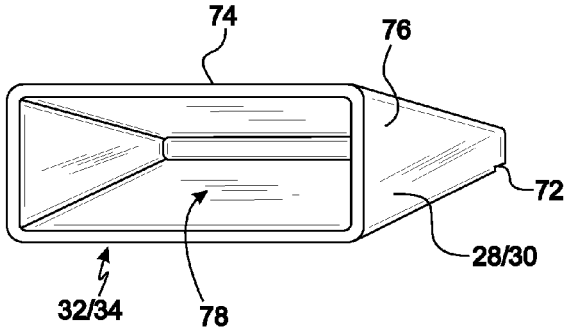

Turning now to FIGS. 15-17, another example clamping member embodiment 70 is shown. In the embodiment 70, the clamping boots 28/30 each include a base 72, an opposing angled wall 74 and a pair of generally triangular side walls 76 interconnecting the base and the angled wall. This configuration defines a interior clamping member receiving pocket 78 (see FIG. 17) that is configured in the shape of the clamping member jaws 22/24. The clamping boots 28/30 may then be respectively mounted to the clamping members 10/12 by virtue of the clamping member receiving pockets enveloping the jaws 22/24 of the clamping members. In this embodiment, no openings are required in the jaws 22/24, and the remainder of the clamping members may also be free of openings other than the apertures 16, 20 and 48 described above with reference to FIGS. 1-3. Like the clamping boots 28/30 of the embodiment 50, the clamping boots of the embodiment 70 may have a variety of surface patterns and surface contours.

Accordingly, a knife sharpener with blade-conforming clamping members has been disclosed. Although various embodiments of the invention have been described, it should be apparent that many variations and alternative embodiments could be implemented in accordance with the invention. It is understood, therefore, that the invention is not to be in any way limited except in accordance with the spirit of the appended claims and their equivalents.

What is claimed is:

1. A knife sharpener with anti-rocking blade holding capability, comprising:

first and second clamping members;

a clamping member adjustment mechanism configured to adjustably manipulate said clamping members into clamping engagement with a knife blade to be sharpened;

said knife blade being maintained by said clamping members in orientation with a planar knife sharpener axis passes through an edge of said knife blade;

first and second deformable clamping boots respectively disposed on said first and second clamping members;

said first and second clamping boots having respective first and second clamping faces adapted to engage said knife blade when said clamping members are in said clamping engagement with said knife blade; and at least one of said clamping faces having a blade-conforming contour that substantially conforms to a surface contour of said knife blade, said blade-conforming contour comprising at least one region that is angled with respect to said planar knife sharpener axis and restrains said knife blade against rocking during sharpening.

2. The knife sharpener of claim 1, wherein both of said first and second clamping faces have a blade-conforming contour that substantially conforms to a surface contour of said knife blade.

3. The knife sharpener of claim 1, wherein said blade-conforming contour comprises a linear configuration.

4. The knife sharpener of claim 1, wherein said blade-conforming contour comprises an angled configuration.

5. The knife sharpener of claim 1, wherein said blade-conforming contour comprises a non-linear configuration.

6. The knife sharpener of claim 1, wherein said blade-conforming contour comprises a curved configuration.

7. The knife sharpener of claim 1, wherein said blade-conforming contour comprises a surface grip pattern on said at least one clamping face.

8. The knife sharpener of claim 7, wherein said surface grip pattern is selected from the group consisting of smooth, ridged, pronged, dimpled and cupped.

9. The knife sharpener of claim 1, wherein said blade-conforming contour of defines a knife receiving clamping cavity in which a spacing between said first and second clamping surfaces decreases toward an edge of said knife.

10. The knife sharpener of claim 1, wherein said blade-conforming contour defines a knife receiving clamping cavity in which a spacing between said first and second clamping surfaces increases toward an edge of said knife.

11. The knife sharpener of claim 1, wherein said blade-conforming contour defines a knife receiving clamping cavity in which a spacing between said first and second clamping surfaces first increases toward an edge of said knife and thereafter decreases toward said edge of said knife.

12. The knife sharpener of claim 1, wherein said first and second clamping members are configured for guiding a sharpening stone at a substantially constant angle relative to said knife blade.

13. The knife sharpener of claim 1, wherein said clamping member adjustment mechanism comprises a fastener adapted to adjustably fasten said clamping members together.

14. The knife sharpener of claim 1, wherein said first and second clamping boots comprise a resilient material.

15. The knife sharpener of claim 1, wherein said first and second clamping boots are respectively mounted to said first and second clamping members by way of one or more clamping boot projections that are received in one or more clamping member openings.

16. The knife sharpener of claim 15, wherein there are two or more of said projections.

17. The knife sharpener of claim 1, wherein said first and second clamping members each comprise a primary clamping surface and a secondary clamping surface that is recessed from said primary clamping surface, said first and second clamping boots respectively covering said primary clamping surface and including a flange that is received against said secondary clamping surface.

18. The knife sharpener of claim 1, wherein said first and second clamping boots comprise a clamping member receiving pocket and are respectively mounted to said first and second clamping members by virtue of said clamping member receiving pockets enveloping an end portion of said clamping members.

19. A knife sharpener with anti-rocking blade holding capability, comprising:

first and second clamping members;

a clamping member adjustment mechanism configured to adjustably manipulate said clamping members into clamping engagement with a knife blade to be sharpened;

said knife blade being maintained by said clamping members in orientation with a planar knife sharpener axis that passes through an edge of said knife blade;

first and second deformable clamping boots respectively disposed on said first and second clamping members;

said first and second clamping boots being respectively mounted to said first and second clamping members by way of one or more clamping boot projections that are received in one or more clamping member openings;

said first and second clamping boots having respective first and second clamping faces adapted to engage said knife blade when said clamping members are in said clamping engagement with said knife blade; and at least one of said clamping faces having a blade-conforming contour that substantially conforms to a surface contour of said knife blade and restrains said knife blade against rocking during sharpening.

20. A knife sharpener with anti-rocking blade holding capability, comprising:

first and second clamping members;

a clamping member adjustment mechanism configured to adjustably manipulate said clamping members into clamping engagement with a knife blade to be sharpened;

said knife blade being maintained by said clamping members in orientation with a planar knife sharpener axis that passes through an edge of said knife blade;

first and second deformable clamping boots respectively disposed on said first and second clamping members;

said first and second clamping boots comprising a clamping member receiving pocket and being respectively mounted to said first and second clamping members by virtue of said clamping member receiving pockets enveloping an end portion of said clamping members; and at least one of said clamping faces having a blade-conforming contour that substantially conforms to a surface contour of said knife blade and restrains said knife blade against rocking during sharpening.

* * * * *